US007011332B2

(12) United States Patent
Zanco

(10) Patent No.: US 7,011,332 B2
(45) Date of Patent: Mar. 14, 2006

(54) SNOW SKIS

(75) Inventor: Alain Zanco, Gillomay (FR)

(73) Assignee: Skis Rossignol SA, Voiron (FR)

( * ) Notice: Subject to any disclaimer, the term of this patent is extended or adjusted under 35 U.S.C. 154(b) by 73 days.

(21) Appl. No.: 10/349,236

(22) Filed: Jan. 22, 2003

(65) Prior Publication Data

US 2003/0234513 A1 Dec. 25, 2003

(30) Foreign Application Priority Data

Jan. 24, 2002 (FR) ..... 02 00916
Apr. 12, 2002 (FR) ..... 02 04659

(51) Int. Cl.
*A63C 5/07* (2006.01)

(52) U.S. Cl. ..... 280/602; 280/609

(58) Field of Classification Search ..... 280/601, 280/602, 608, 609
See application file for complete search history.

(56) References Cited

U.S. PATENT DOCUMENTS 3,424,469 A * 1/1969 Hooker ..... 280/608
3,537,717 A * 11/1970 Caldwell ..... 280/602
4,300,786 A * 11/1981 Alley ..... 280/602
4,974,867 A 12/1990 Rullier et al.
5,064,214 A * 11/1991 Diard et al. ..... 280/607
5,251,924 A * 10/1993 Nussbaumer ..... 280/602
5,280,943 A * 1/1994 Commier et al. ..... 280/609
5,333,889 A * 8/1994 Piegay et al. ..... 280/602
5,427,401 A * 6/1995 Liard ..... 280/609
5,435,588 A * 7/1995 Commier et al. ..... 280/602
5,447,322 A 9/1995 le Masson et al.
5,871,223 A 2/1999 Zanco
6,467,796 B1 * 10/2002 Weltman et al. ..... 280/615

FOREIGN PATENT DOCUMENTS

FR 2610527 12/1987

* cited by examiner

*Primary Examiner*—Christopher P. Ellis
*Assistant Examiner*—Brian Swenson
(74) *Attorney, Agent, or Firm*—Fay, Sharpe, Fagan, Minnich & McKee, LLP

(57) ABSTRACT

A snow shoe (1) such as a ski, a single ski board or a snowboard, having a vertical plane of general symmetry, comprising a principal portion, called a body or support base (2) to which is attached, at least in the zone of the sole plate, at least one complementary longitudinal element (3*a*, 3*b*). The complementary element(s) is/are retained in a corresponding lateral disengagement unit, which emerges laterally and in upward direction (HA) towards the exterior (EX), while it does not issue in downward direction (BA).

19 Claims, 10 Drawing Sheets

SNOW SKIS

BACKGROUND OF THE INVENTION

The present invention relates to a board for sliding on snow, such as a ski, a monoski, a snowboard, or other. It concerns, more particularly, an improvement with respect to a snowboard, comprising a support base on which is attached at least one complementary element.

In recent years, sliding on snow as an athletic activity has been increasingly adapted and immensely developed, with the practitioners demanding more and more with respect to product quality. This is the case, for example, concerning sliding or surfing on snow.

A great number of snowboard models are already known, and notably models of skis, which constitute a plank of elongated shape, whose front extremity is raised to form a spatula, while the lower surface comprises a sliding sole, edged by metal squares.

In spite of all the efforts developed by equipment builders in order to satisfy their clients, there does not exist to this day any ski which perfectly combines user comfort with trajectory characteristics, regardless of the type of terrain or the type of user.

SUMMARY OF THE INVENTION

The present invention proposes multi-purpose skis, formed by a support base and at least one complementary element, whose cooperation in regard to shape, dimension and structure provides to the ski ensemble the required characteristics combined with handling comfort and convenience.

Consequently, according to the invention, the board for sliding on snow, such as a ski, a monoski, or a snowboard is of the type which comprises a principal portion, called the body or the support base, to which is attached, at least in the zone of the skating plate, at least one complementary element, and it is characterized in that the complementary element or elements is/are retained in a corresponding lateral disengagement unit, which extends laterally toward the exterior and in upward direction, but does not issue towards the bottom.

According to a complementary characteristic, the support base is provided with its appropriate thickness distribution, slope line, width and stiffness. According to one preferred mode of embodiment it comprises a longitudinal rib, bordered by two lateral disengagement units, whose width is smaller than the width of the lower portion.

According to other complementary embodiment, the width and or the height of the disengagement units is longitudinally variable—it is greater at the center of the ski and diminishes toward the front and/or toward the rear.

According to another embodiment, the complementary lateral element(s) is/are formed by elongated profiles, which are of beneficially transverse tapered section with regard to their dimensions and or their shapes.

It should be added that the width and/or the height of the complementary lateral elements is longitudinally variable,—it is more significant in the center of the ski and diminishes toward the front and/or toward the rear.

It is noted that in the preferred embodiment the length of the complementary lateral elements comprises between 30% and 60% of the length of the support base, while the height is slightly greater than the corresponding height of the disengagement unit.

According to a complementary embodiment, to a given support base corresponds a set of several complementary elements, which are laterally different by length, and/or by width, and/or by thickness, by their mechanical characteristics, by their structure or their geometry.

It should be noted that two straps are provided, one front strap and one rear strap, on which are fixed the bindings intended to retain the boot of the user.

According to a variation, the two straps are connected to each other in order to form one and the same strap.

Other characteristics and benefits of the invention are apparent from the description which follows with respect to the attached drawings, which are provided by way of example only and are not limited thereto.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

FIG. 1 is a bird's eye view of the ski, showing its support base with its two complementary lateral elements.

FIG. 2 is a lateral view of the ski, i.e. a view of its support base with its two complementary lateral elements.

FIG. 3 is a perspective view of the support base prior to putting into place its complementary lateral elements.

FIG. 4 is a perspective view of the ski, showing the base with its complementary lateral elements.

FIGS. 5A, 5B, 5C, 5D, 5E are enlarged views through sections A—A, B—B, C—C, D—D, and E—E, respectively, of the support base only, prior to putting into place the complementary lateral elements.

FIGS. 6A, 6B, 6C, 6D, and 6E are enlarged views through according to sections A—A, B—B, C—C, D—D, and E—E, respectively, of the ski, with its complementary lateral elements, put in place on the support base.

FIG. 8 is a lateral view, showing how the two complementary elements can be retained on the support base.

FIG. 10' is a schematic view, in transverse section, of a ski of this type combining a shell and lateral fields

DETAILED DESCRIPTION OF THE PREFERRED EMBODIMENTS

Figure 1:
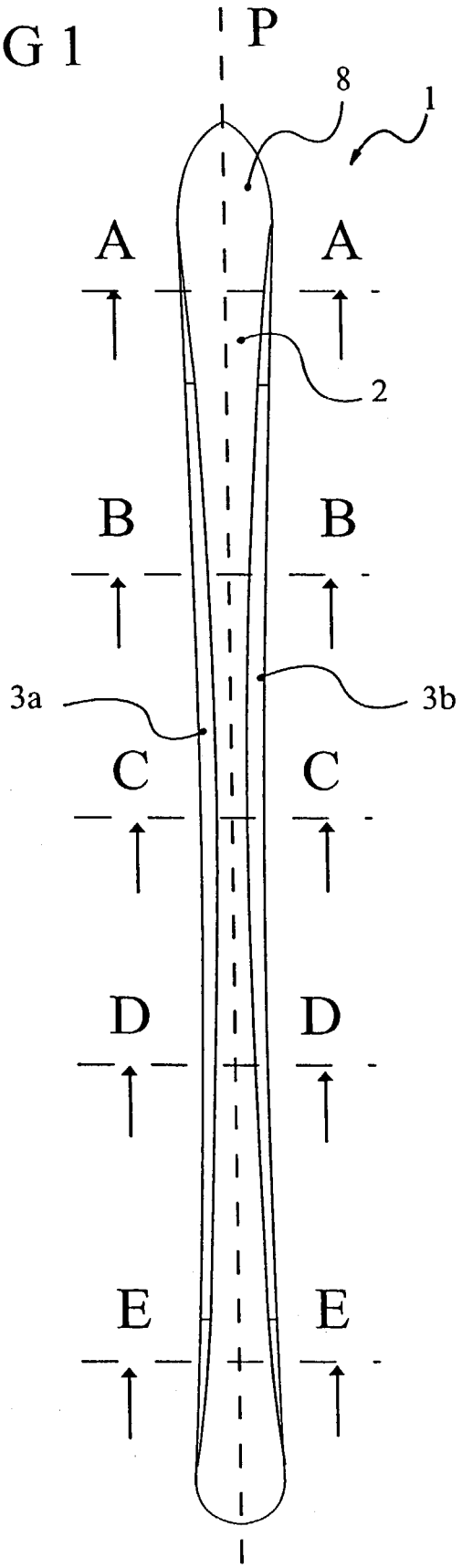
FIGS. 1, 2, 3, 4, 5A, 5B, 5C, 5D, 5E, 6A, 6B, 6C, 6D, 6E and 8 represent a first mode of embodiment of the invention.
Figure 2:
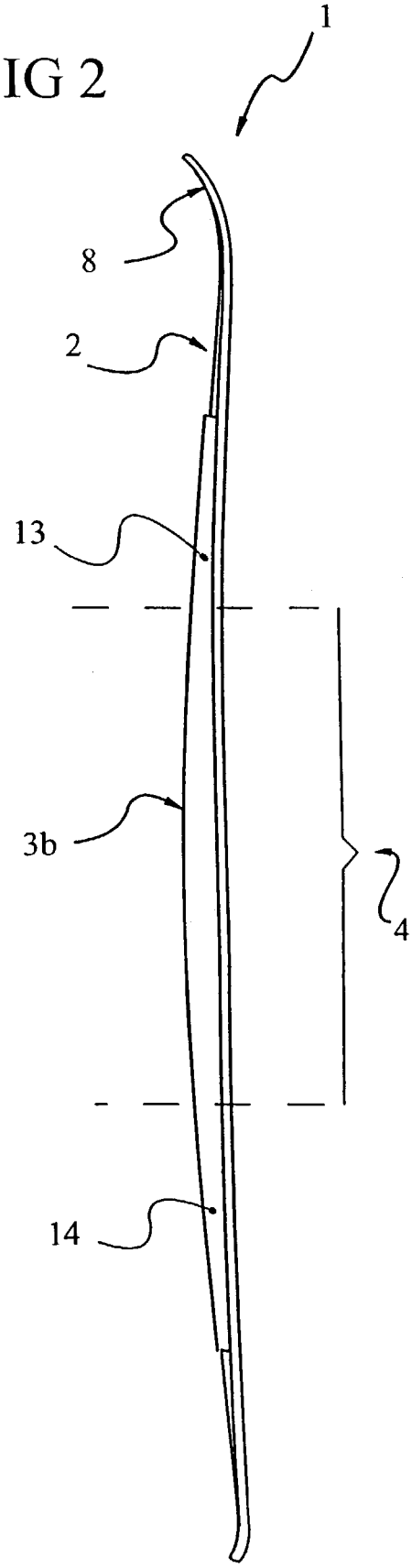
Figure 3:
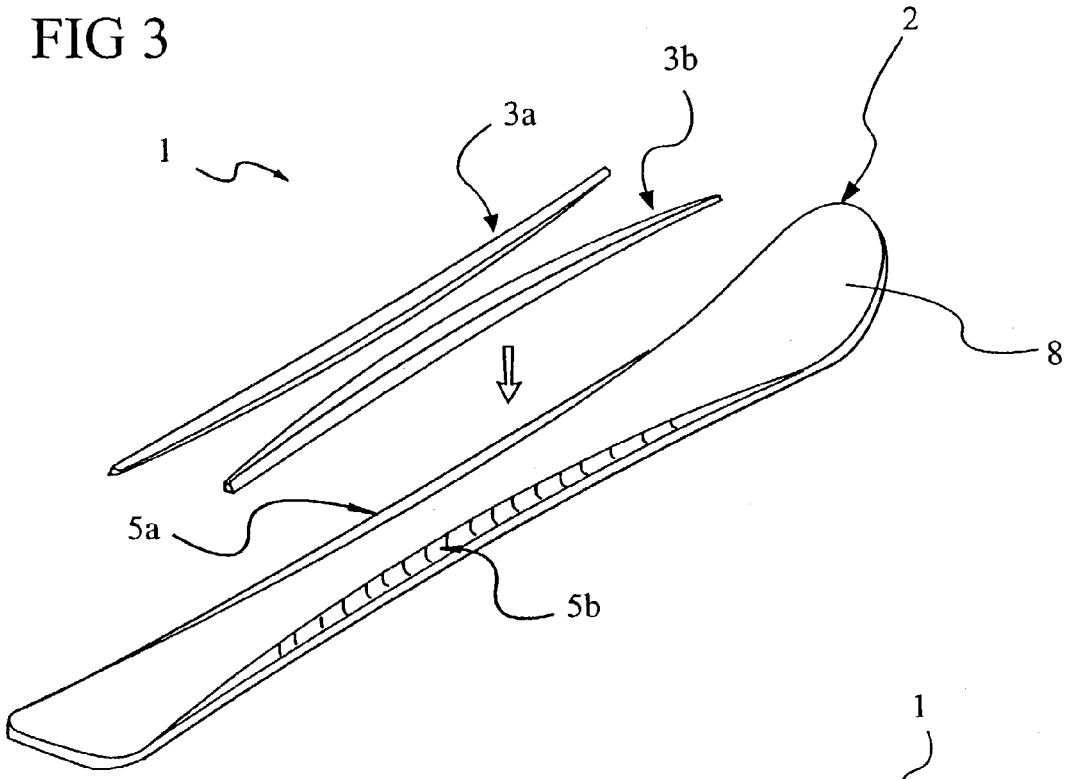
Figure 4:
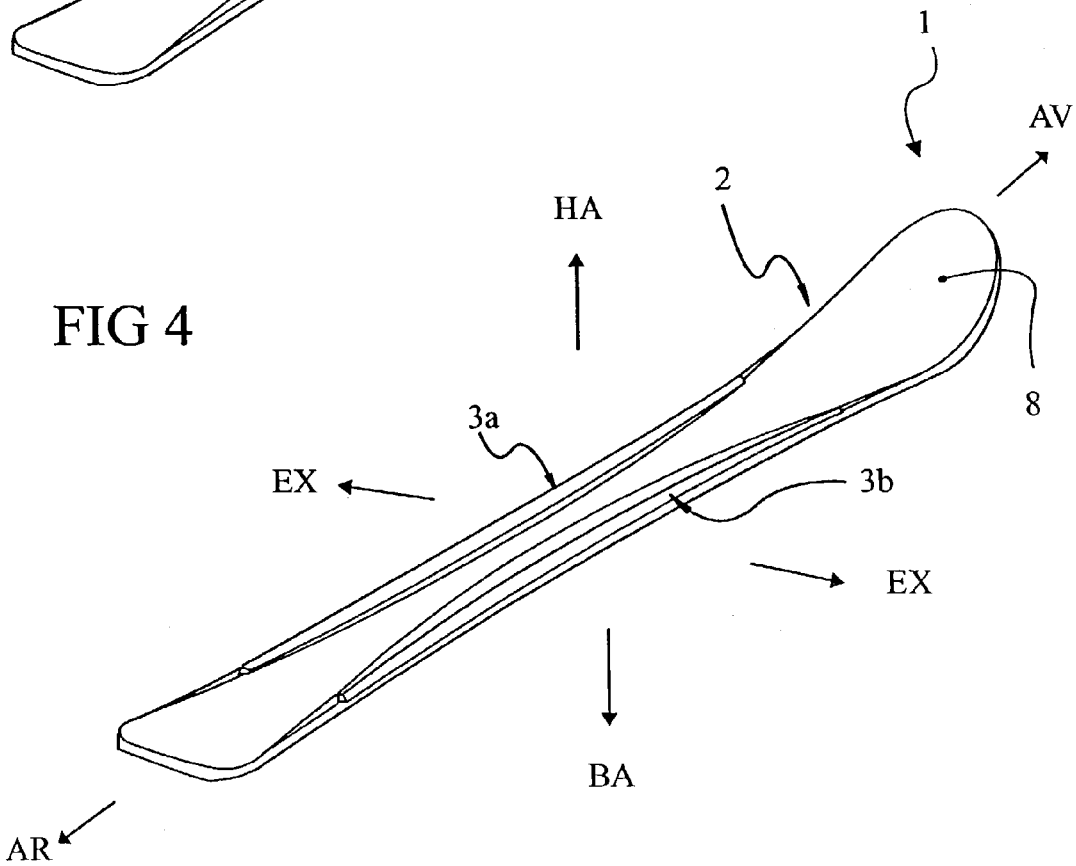
Figure 5A:
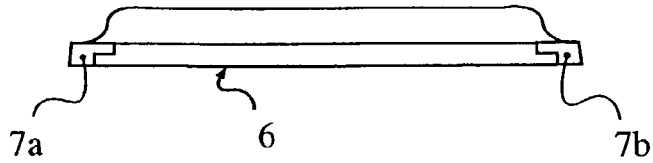
Figure 5B:
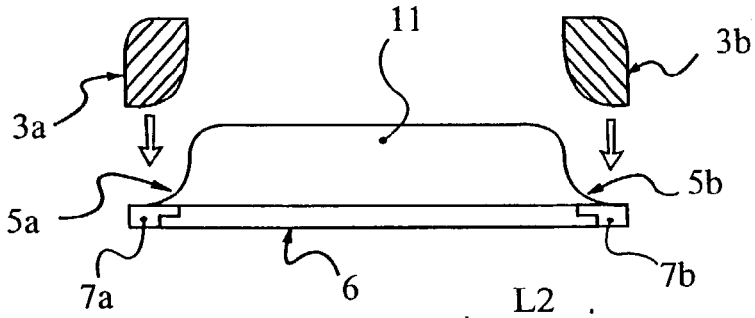
Figure 5C:
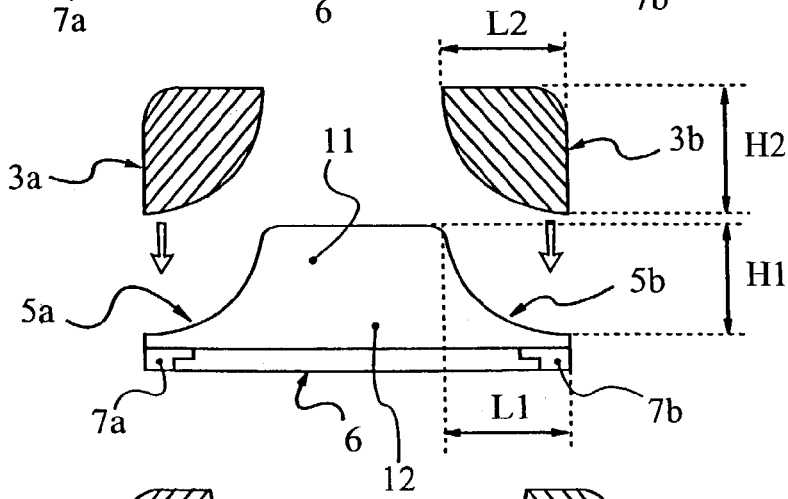
Figure 5D:
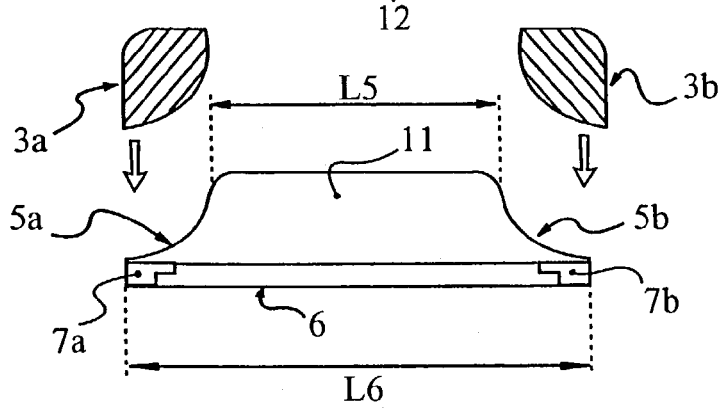
Figure 5E:
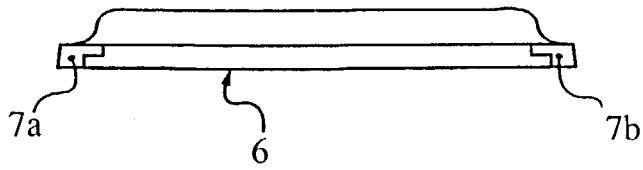
Figure 6A:
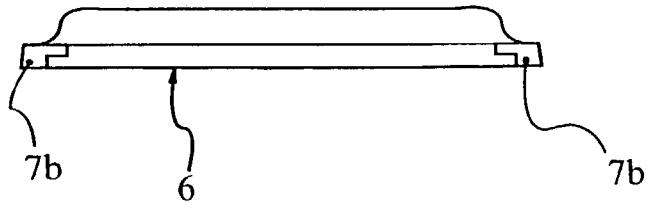
Figure 6B:
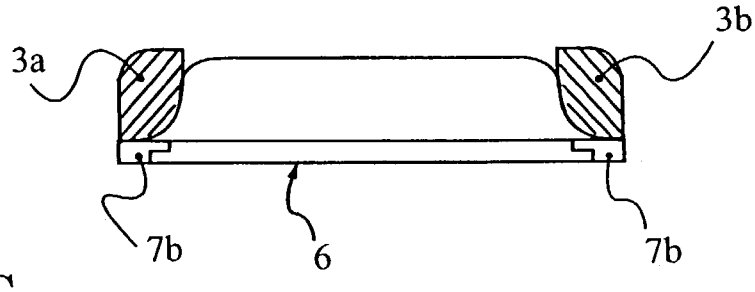
Figure 6C:
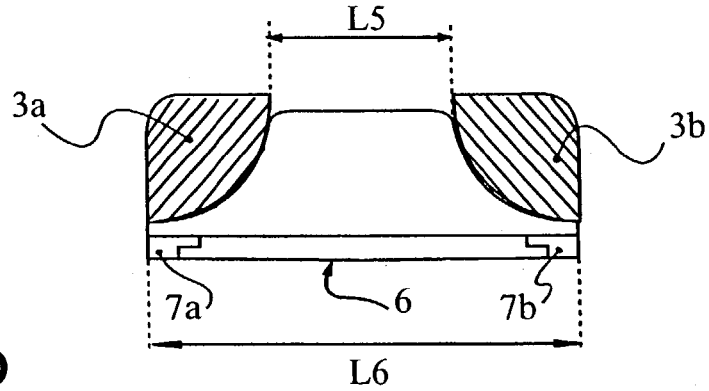
Figure 6D:
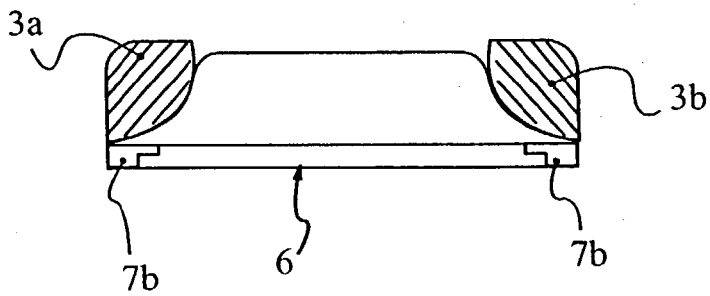
Figure 6E:
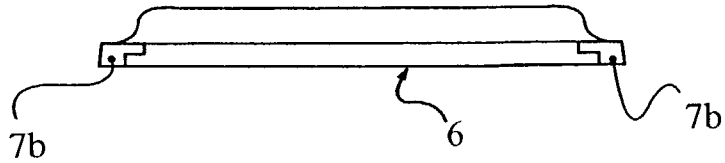

The ski identified by general reference (1) is a set of elongated shapes having a median longitudinal vertical plane (P) of general symmetry, whose front is raised in order to form a spatula (8).

The ski (1) is formed by a principal part which shall be called a body or support base (2) on which is fixed, at least in the area of a contact surface or flange (4), at least one complementary element, and, according to a referred embodiment, two complementary lateral elements (3*a*, 3*b*).

The support base (2) is the element in contact with the snow and has the shape of an elongated plank, presenting at its lower surface a sliding sole (6) bordered laterally by lateral metal squares (7*a*, 7*b*) (FIG. 5).

The support base (2) is an elongated plank, whose front extremity is raised in order to form the spatula (8) of the ski. The support base (2) has its appropriate thickness distribution, slope line, width and stiffness and can be of any type and constitution.

Thus, the elongated plank forming the support base (2) can be of any type of design, known until now, such as, for example, sandwich type, encasement type, shell type or even of the type combining shell and lateral fields, used singly or in combination,—indeed even mixed and constituted by a set of elements and components known by themselves.

Figure 10:
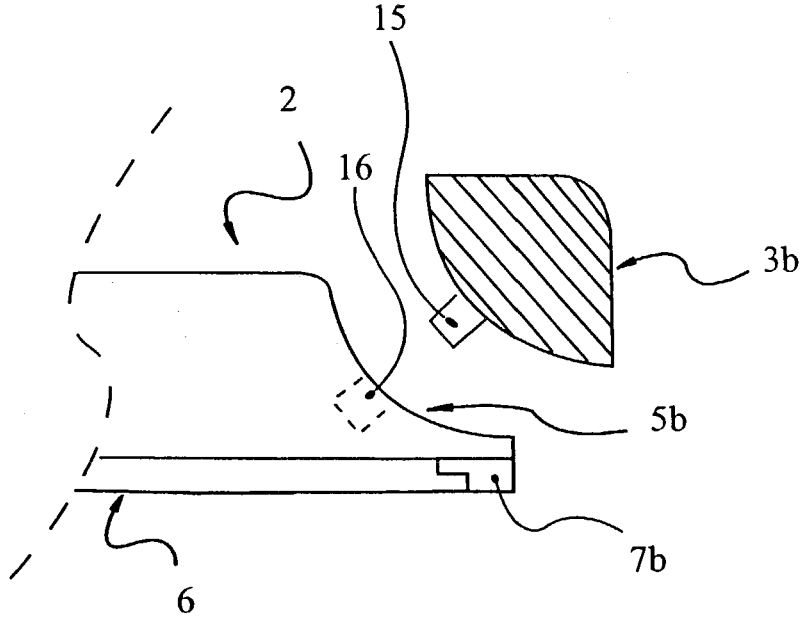
FIG. 10 is a partial view, in transverse section, indicating how the connection between the complementary elements and the support base can also be assured.
Figure 10:
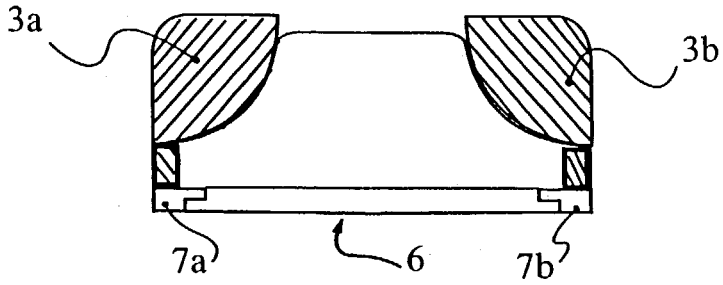

FIG. 10' is a schematic view in transverse section of a type of ski combining a shell and lateral fields.

The two complementary lateral elements (3*a*, 3*b*) are formed by elongated profiles, whose section in transverse cut is beneficially tapered in its dimensions and/or shapes.

As for the support base (2), each of the complementary lateral elements (3*a*, 3*b*) has its own configuration and structure. It has its own thickness distribution, width and stiffness and can be of any type of construction. Thus, the complementary elements (3*a*, 3*b*) can be formed by a single-block element formed of one and the same material. But it can also have any other design, such as, for example, it can be formed by a profile having a somewhat tubular shape, comprising an external wall formed, for example, of a composite material, whose central portion is hollow or filled with a filling material, such as a synthetic foam.

In the embodiment given by way of example, each of the complementary lateral elements (3*a*, 3*b*) is a profile whose section diminishes in width and thickness towards the front (AV) and towards the rear (AR).

According to one embodiment the support base (2) comprises lateral disengagement units or housings (5*a*, 5*b*), with one of the corresponding complementary lateral elements (3*a*, 3*b*) being fixed within each of these. Thus, the support base (2) comprises a left lateral disengagement unit (5*a*), within which is fixed the complementary left lateral element (3*a*) and a right lateral disengagement unit (5*b*), within which is fixed the complementary right lateral element (3*b*).

It should be stated that each of the lateral disengagement units (5*a*, 5*b*) extends laterally towards the exterior (EX) and in upward direction (HA), while it does not extend in downward direction (BA).

It should be noted that the width (L1) of the disengagement units (FIG. 5C) is longitudinally benefically variable, it is wider at the center of the ski, and diminishes toward the front (AV) and/or toward the rear (AR).

Likewise, the height (H1) of the disengagement units (5*a*, 5*b*) is beneficially variable longitudinally (FIG. 5C), it is greater at the center of the ski, while diminishing toward the front (AV) and/or toward the rear (AR).

According to a preferred embodiment, the height (H2) of the profile of each of the complementary lateral elements (3*a*, 3*b*) is slightly higher than the height (H1) of the corresponding disengagement unit (5*a*, 5*b*).

In addition, the width (L2) of the complementary elements (3*a*, 3*b*) is beneficially variable longitudinally, it is wider at the center of the ski and diminishes toward the front (AV) and/or toward the rear (AR) while their height (H2) is likewise beneficially variable longitudinally, it is greater at the center of the ski while diminishing toward the front (AV) and/or toward the rear (AR).

By way of example, it should be noted that the length (L3) of the complementary lateral elements (3*a*, 3*b*) can comprise between 30% and 60% of the length (L4) of the support base (2). Thus, the length (L3) of the complementary elements can range between 50 and 100 centimeters.

The two complementary lateral elements (3*a*, 3*b*) beneficially have the same length, but can have different lengths.

The shape of the transverse section of each of the elements (3*a*, 3*b*) can be as illustrated, or it can be square, round, rectangular or other. It should also be noted that the section can have a tapering shape and vary in length.

According to a complementary embodiment, a set of several complementary lateral elements (3*a*, 3*b*—3'*a*, 3'*b*-3"*a*, 3"*b*) can correspond to one support base (2).

Figure 7:
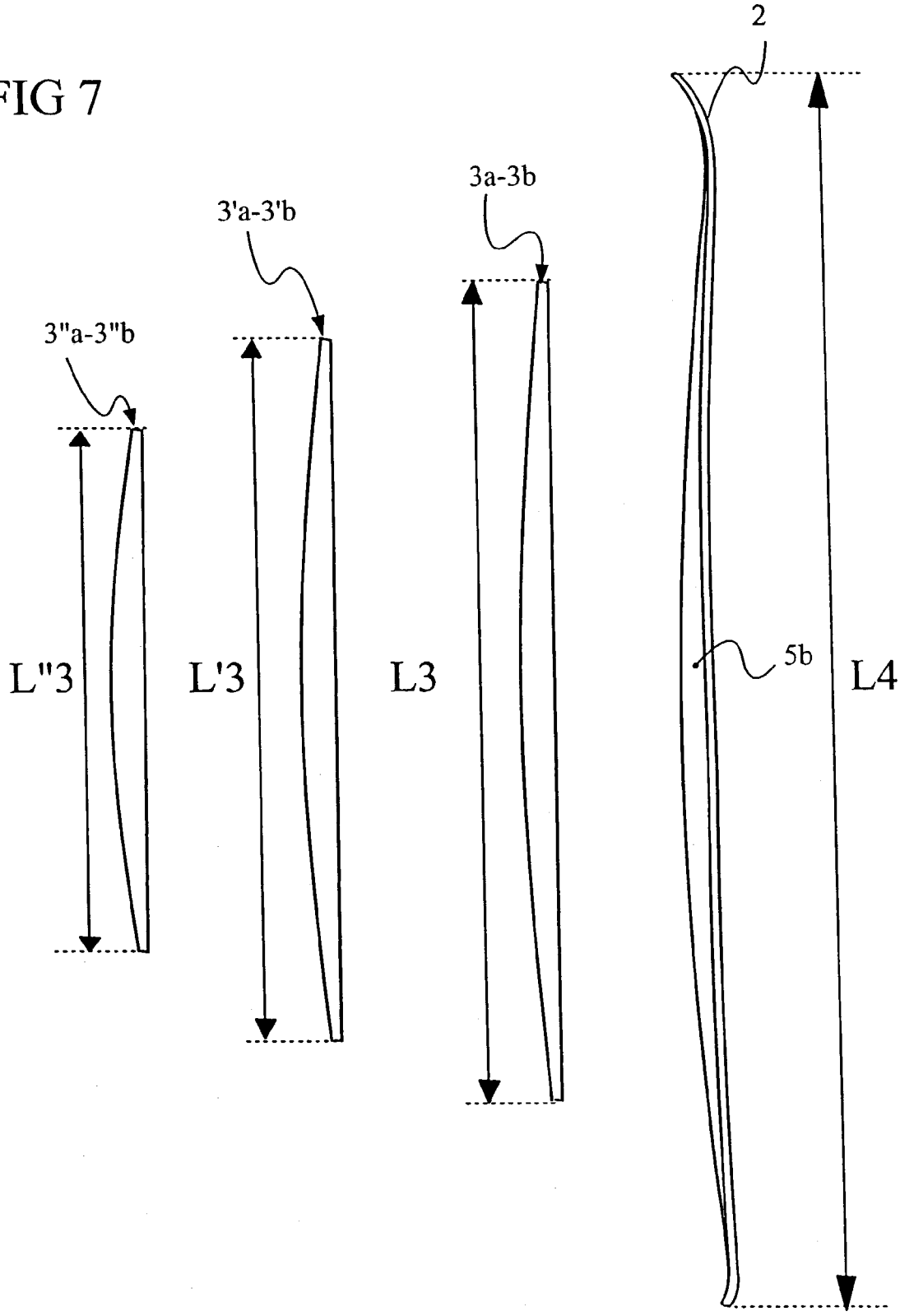
FIG. 7 is a lateral view of another embodiment showing several complementary lateral elements corresponding to a given support base.

Thus, several complementary elements (3*a*, 3*b*) of different lengths (L3, L'3, L1"3) can correspond to a given support base (2), such as, for example, three complementary elements of different lengths as illustrated in FIG. 7. Likewise, several complementary elements of different thickness can correspond to a given support base (2). It should also be noted that several complementary elements with different mechanical characteristics, intended to confer to the ski (1), formed by the support base (2) and its complementary elements (3*a*, 3*b*), different behavior characteristics, can correspond to one given support base (2). The different characteristics can be obtained by different thicknesses of the complementary elements, or by different structure, even by different materials, indeed—even by different geometry.

Figure 8:
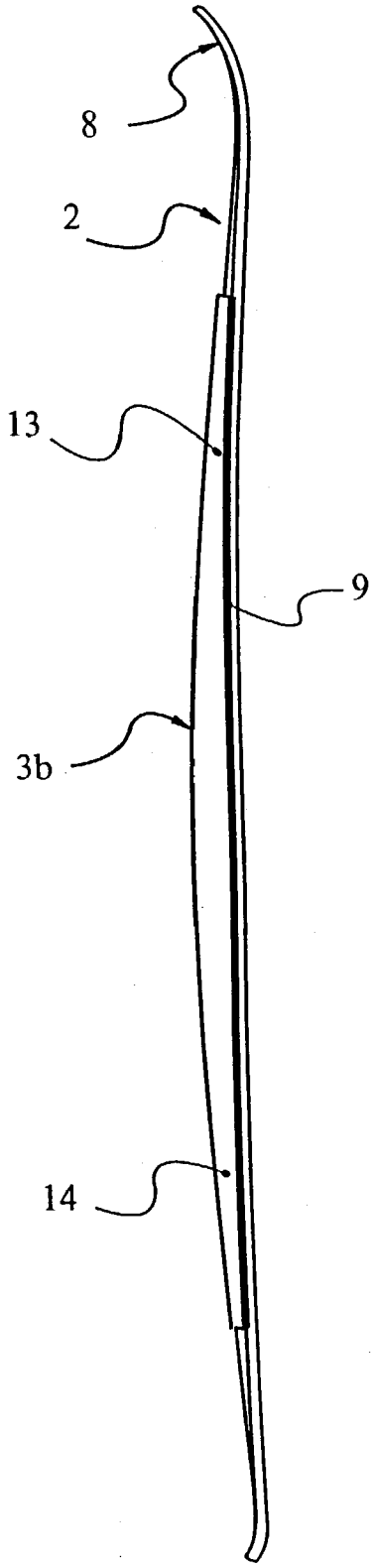
Figure 9:
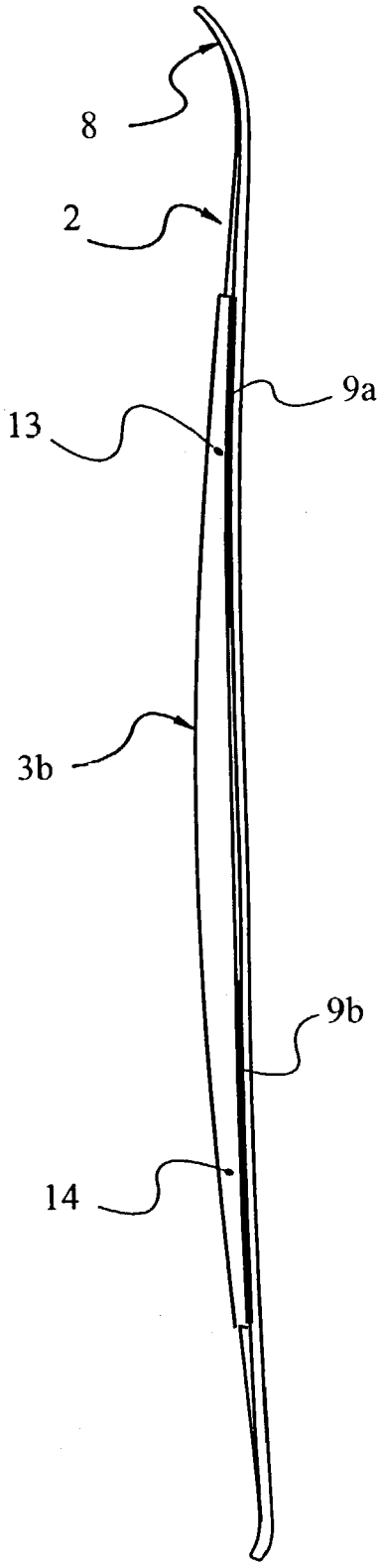
FIG. 9 is a lateral view illustrating a variation of the embodiment of FIG. 8.

The fixing of the complementary elements (3*a*, 3*b*) on the support base (2) takes place, needless to say, by putting into place and fixing the complementary elements within the corresponding housing (5*a*, 5*b*). The connection can be achieved, for example, by means of glue attachment, or welding. The connection (9) can be effected over the entire common surface of the complementary element (3) with its housing, as illustrated in FIG. 8, or the connection (9*a*, 9*b*) can be effected over only part of the common surface, for example in the zones of the front portion (13) and the rear portion (14), as is represented in FIG. 9.

Needless to say, it is possible to provide for the connection of the complementary elements (3*a*, 3*b*) with the support base (2) to be accomplished mechanically, such as, for example, by embedding of projections (15) in corresponding holes (16), as is represented in FIG. 10.

It is to be noted that the thickness of the complementary elements (3*a*, 3*b*) can be constant or variable.

Figure 11:
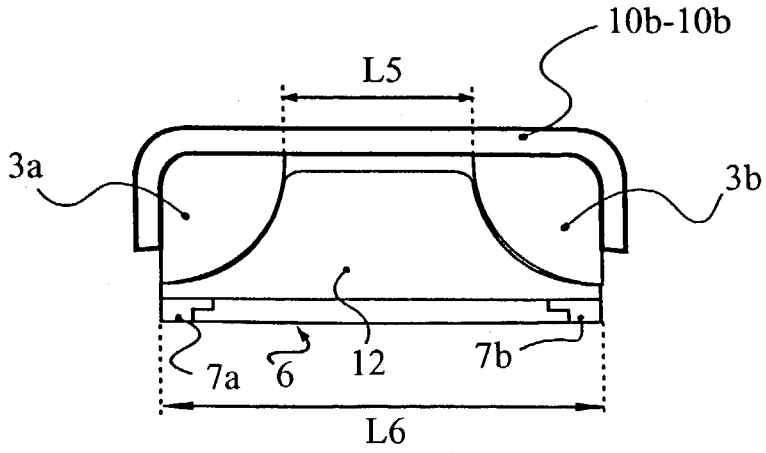
FIG. 11 is a transverse view of another embodiment of a ski in which the bindings are fixed on a strap connected to complementary lateral elements.
Figure 12:
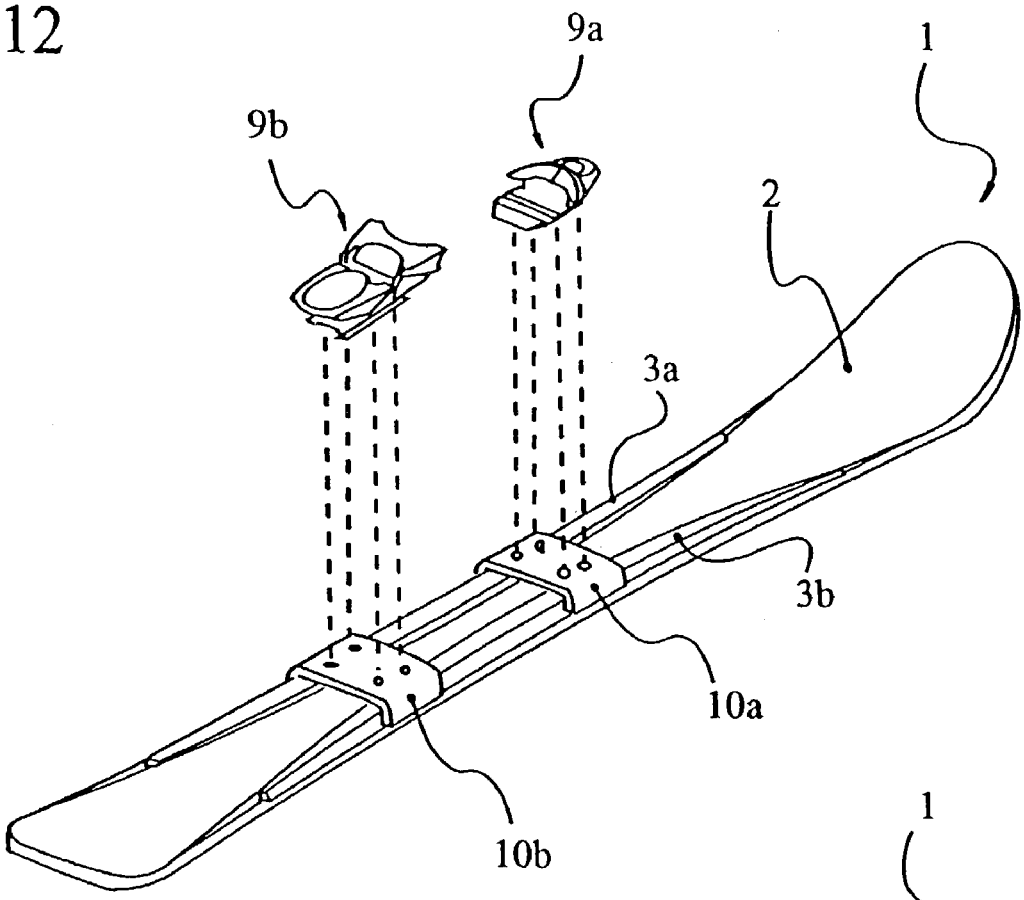
FIG. 12 is a perspective view of the ski of FIG. 11.

FIGS. 11 and 12 illustrate how the ski bindings (9*a*, 9*b*), intended to retain the boot of the skier, can be fastened. To that end, two straps are provided, for example a front strap (10*a*), a rear strap (10*b*) on which are attached the bindings (9*a*, 9*b*). The straps are fixed on the complementary lateral elements. It should be noted that the strap can be fastened to the complementary lateral elements (3*a*, 3*b*) by any known means, such as by glue, screw connection etc. . . . .

The bindings (9*a*, 9*b*) could be not fastened to an intermediary strap, such as the previously described straps, but could be fastened to the complementary lateral elements (3*a*, 3*b*) or, of course, to the support base (2).

Figure 13:
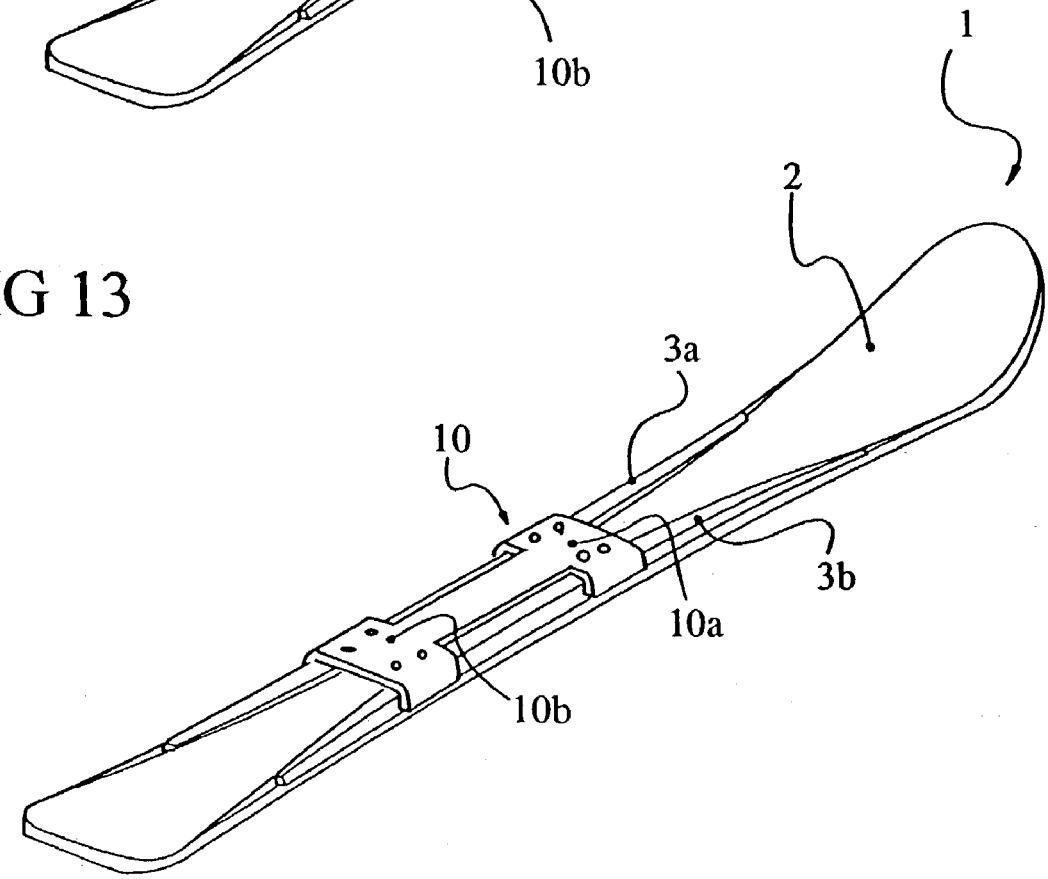
FIG. 13 is a perspective view of another embodiment of a ski similar to FIG. 12, illustrating a variation of the retention bindings.

FIG. 13 is a view which is similar to FIG. 12, depicting a variation of a specific embodiment according to which the two straps (10*a*, 10*b*) are connected with each other in order to form one and the same strap (10).

Figure 14:
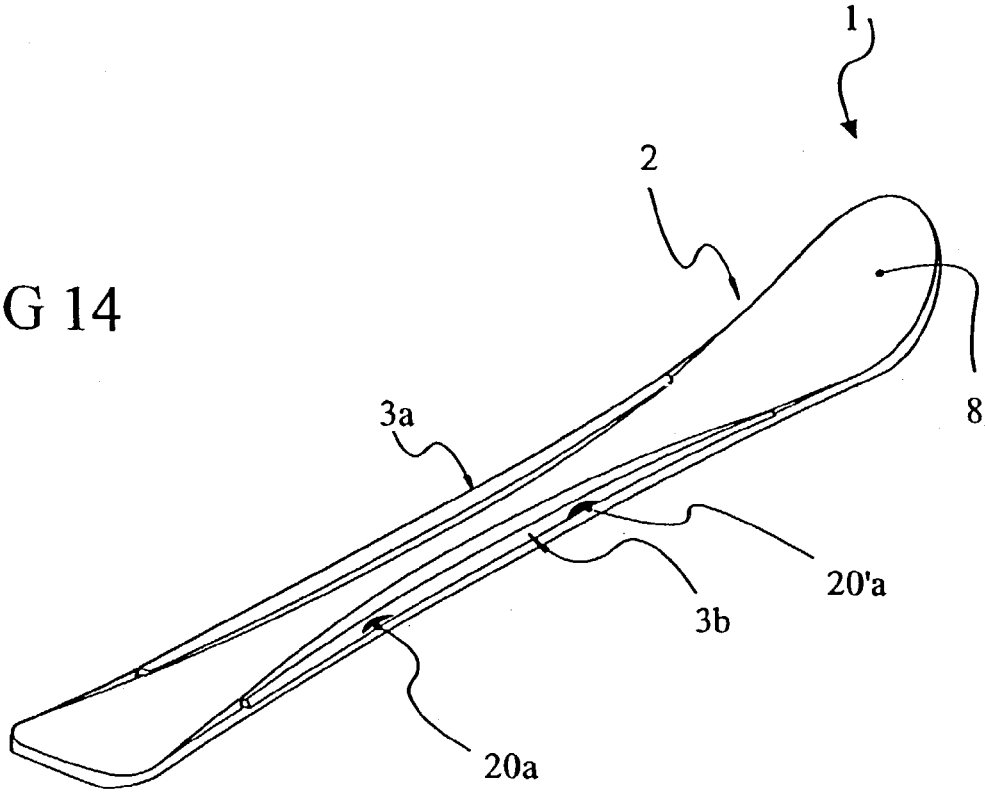
FIG. 14 is a perspective view of a first of three variations according to which the complementary lateral elements comprise shock-absorbing elements.
Figure 15:
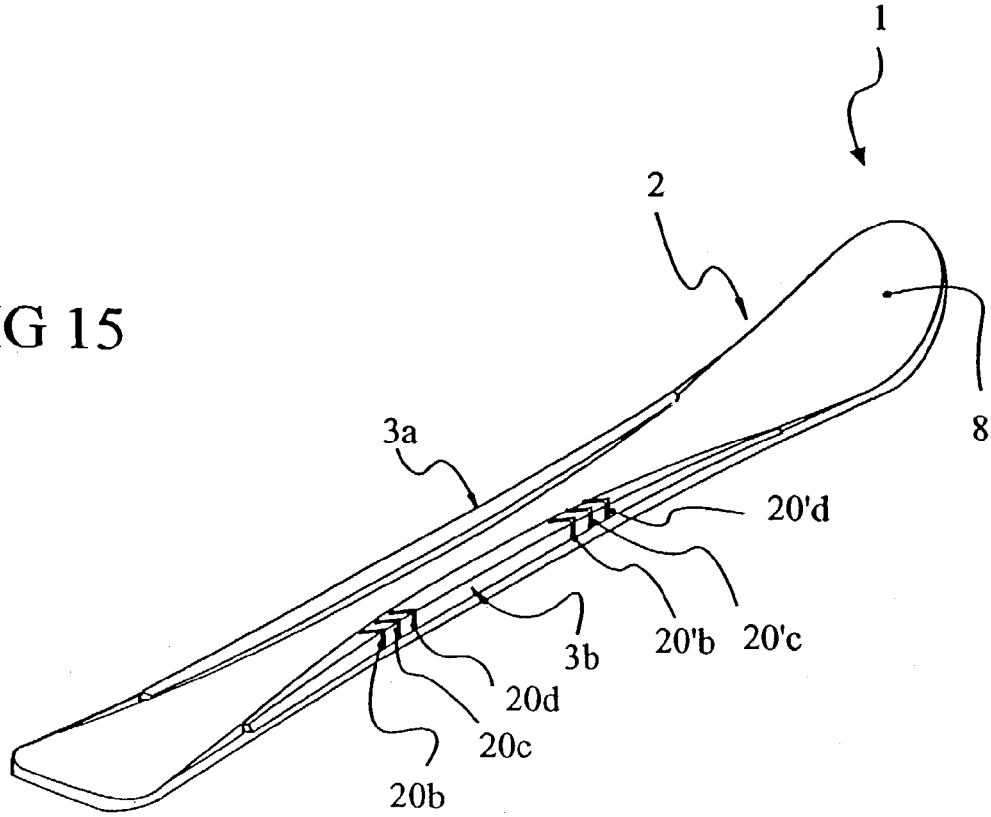
FIG. 15 is a perspective view of a second of three variations according to which the complementary lateral elements comprise shock-absorbing elements.
Figure 16:
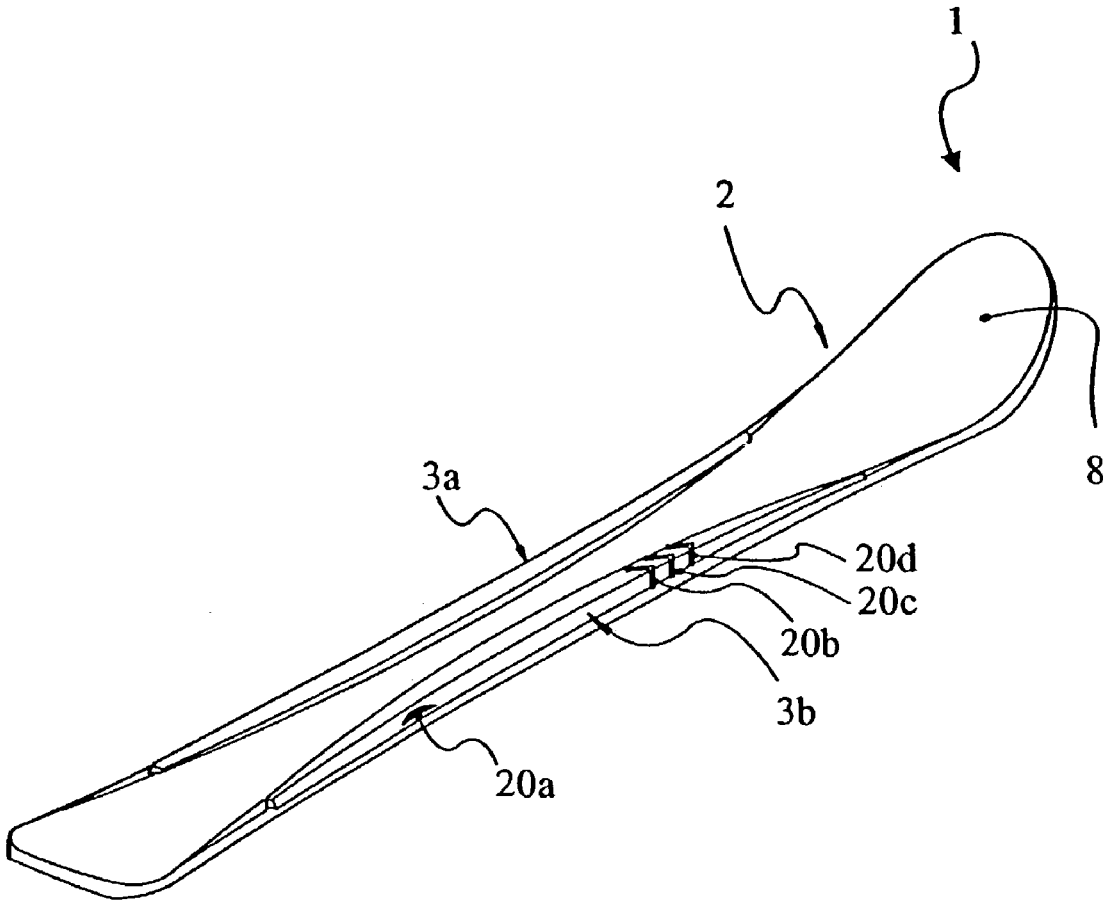
FIG. 16 is a perspective view of a third of three variations according to which the complementary lateral elements comprise shock-absorbing elements.

FIGS. 14, 15, and 16 are perspective views indicating three embodiments, according to which deformation and shock-absorbing elements (20*a*, 20'*a*, 20*b*, 20'*b*, 20*c*, 20'*c*, 20*d*, 20'*d*) are provided within the complementary elements (3*a*, 3*b*). These deformation elements are formed of elastic, elastomeric or viscous material, such as foam, natural or synthetic rubber or other.

It is understood that in the zone which is occupied by the complementary lateral elements, the support base (2) could comprise a longitudinal rib (11) (FIG. 5D), bordered by two lateral disengagement units (5*a*, 5*b*), whose width (L5) is smaller than the width (L6) of the lower portion (12) of the support base (2). Each of the lateral disengagement units is thus limited vis-a-vis the plane of symmetry (P) by the longitudinal rib (11) and, towards the bottom, by the lower portion (12) of the support base which comprises the metal squares (7*a*, 7*b*) and the sliding sole (6).

It should also be added that the ski (1) can be such that the complementary left element (3*a*) would differ from the complementary right (3*b*) element, with respect to length, as was mentioned previously, but also by its cross-section, its transverse dimensions, its constructive characteristics, even by its technical characteristics.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A board for sliding on snow having a vertical plane of general symmetry comprising:

a support base having a longitudinal rib bordered by two lateral disengagement units whose width is smaller than a width of a lower portion of said support base;

at least one complementary longitudinal element retained in a corresponding lateral disengagement unit of the support base, which lateral disengagement unit extends laterally toward an exterior and in an upward direction, without extending in a downward direction, the complementary lateral element having transverse cross section that tapers along its longitudinal length insofar as at least one of its dimensions and its shape are concerned.

2. The board for sliding on snow according to claim 1, wherein the support base has an appropriate thickness distribution, slope line, width and stiffness.

3. The board for sliding on snow according to claim 1, wherein the at least one complementary lateral element is formed by elongated profiles.

4. The board for sliding on snow according to claim 1, wherein the board is selected from the group comprising a ski, a snowboard, and a monoski.

5. The board for sliding on snow according to claim 1, further including: two straps, including a front strap and a rear strap, on which bindings are fixed.

6. The board for sliding on snow according to claim 5, wherein the two straps are connected to each other in order to form one and the same strap.

7. The board for sliding on snow according to claim 5, wherein the straps are fastened to the complementary lateral elements.

8. A board for sliding on snow having a vertical plane of general symmetry comprising:

a support base to which is removably attached at least one elongated complementary longitudinal element, the at least one elongated complementary element being retained in a corresponding lateral disengagement unit which extends laterally toward an exterior and in an upward direction, without extending in a downward direction, at least one of a width and a height of the elongated complementary lateral elements varying by being greater at a center of the board and diminishing continuously and progressively toward at least one of a front and a rear of the board.

9. The board for sliding on snow according to claim 8, wherein the elongated complementary lateral element has a tapering transverse cross section insofar as at least one of its dimensions and shape is concerned.

10. The board for sliding on snow according to claim 8, wherein the support base comprises a longitudinal rib bordered by two lateral disengagement units whose width is smaller than a width of a lower portion of said support base.

11. The board for sliding on snow according to claim 10, wherein a width and a height of the disengagement units varies longitudinally, in that it is greater at a center of the board and diminishes toward one or more of a front and a rear of the board.

12. The board for sliding on snow according to claim 11, wherein a height of a profile of each of the complementary lateral elements is slightly greater than the height of the corresponding disengagement unit.

13. A board for sliding on snow having a vertical plane of generally symmetry comprising:

a support base to which is attached complementary longitudinal elements, a length of each complementary lateral element being within 30% and 60% of a length of the support base, the complementary elements being retained in corresponding lateral disengagement units which extend laterally toward an exterior and in an upward direction, without extending in a downward direction, the complementary longitudinal elements tapering along their longitudinal length to provide greater stiffness at the center of the ski.

14. The board for sliding on snow according to claim 13 wherein each complementary lateral element has a different length.

15. A board for sliding on snow having a vertical plane of general symmetry comprising:

a support base to which defines a least one lateral disengagement unit for releasably receiving a complementary lateral element, the disengagement unit extending laterally toward an exterior and in an upward direction along the support base, without extending in a downward direction; and a set of several complementary lateral elements with different characteristics corresponds to one support base and are individually releasably retained in the disengagement unit, the complementary longitudinal elements each tapering along its longitudinal length to provide greater stiffness at the center of the ski.

16. The board for sliding on snow according to claim 15, wherein complementary lateral elements of the set of several complementary lateral elements differ in at least one of length, width, and thickness.

17. The board for sliding on snow according to claim 15, wherein complementary lateral elements of the set of several complementary lateral elements have different mechanical characteristics.

18. The board for sliding on snow according to claim 15, wherein complementary lateral elements of the set of several complementary lateral elements are of different structure.

19. The board for sliding on snow according to claim 15, wherein complementary lateral elements of the set of complementary lateral elements are of different geometry.

* * * * *